US007122816B2

(12) United States Patent
Algots et al.

(10) Patent No.: US 7,122,816 B2
(45) Date of Patent: Oct. 17, 2006

(54) METHOD AND APPARATUS FOR EUV LIGHT SOURCE TARGET MATERIAL HANDLING

(75) Inventors: J. Martin Algots, San Diego, CA (US); Oscar Hemberg, La Jolla, CA (US); Tae H. Chung, San Diego, CA (US)

(73) Assignee: Cymer, Inc., San Diego, CA (US)

( * ) Notice: Subject to any disclaimer, the term of this patent is extended or adjusted under 35 U.S.C. 154(b) by 13 days.

(21) Appl. No.: 11/088,475

(22) Filed: Mar. 23, 2005

(65) Prior Publication Data

US 2006/0192155 A1 Aug. 31, 2006

Related U.S. Application Data

(63) Continuation-in-part of application No. 11/067,124, filed on Feb. 25, 2005.

(51) Int. Cl.
*H01J 35/20* (2006.01)
*G21K 5/10* (2006.01)

(52) U.S. Cl. ..... 250/504 R; 250/492.2; 250/493.1; 378/119

(58) Field of Classification Search ..... 250/504 R, 250/492.2, 493.1; 378/119
See application file for complete search history.

(56) References Cited

U.S. PATENT DOCUMENTS

| | | | | |
|---|---|---|---|---|
| 2,759,106 | A | 8/1956 | Wolter | 250/53 |
| 3,150,483 | A | 9/1964 | Mayfield et al. | 60/35.5 |
| 3,232,046 | A | 2/1966 | Meyer | 50/35.5 |
| 3,279,176 | A | 10/1966 | Boden | 60/202 |
| 3,746,870 | A | 7/1973 | Demarest | 250/227 |
| 3,960,473 | A | 6/1976 | Harris | 425/467 |
| 3,961,197 | A | 6/1976 | Dawson | 250/493 |
| 3,969,628 | A | 7/1976 | Roberts et al. | 250/402 |
| 4,042,848 | A | 8/1977 | Lee | 313/231.6 |
| 4,088,966 | A | 5/1978 | Samis | 313/231.5 |

(Continued)

FOREIGN PATENT DOCUMENTS

JP 2000091096 A 3/2000

OTHER PUBLICATIONS

Andreev, et al., "Enhancement of laser/EUV conversion by shaped laser pulse interacting with Li-contained targets for EUV lithography", *Proc. of SPIE*, 5196:128-136, (2004).

(Continued)

*Primary Examiner*—Kiet T Nguyen
*Assistant Examiner*—Johnnie L Smith, II
(74) *Attorney, Agent, or Firm*—William C. Cray

(57) ABSTRACT

An EUV light source plasma source material handling system and method is disclosed which may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is on line; a transfer mechanism transferring liquid plasma source material from the supply reservoir to the droplet generator plasma source material reservoir, while the droplet generator is on line. The supply reservoir may comprise a solid form of the plasma source material used to periodically form from a portion of the material in solid form the material in liquid form.

25 Claims, 6 Drawing Sheets

U.S. PATENT DOCUMENTS 4,143,275 A 3/1979 Mallozzi et al. ..... 250/503
4,162,160 A 7/1979 Witter ..... 75/246
4,203,393 A 5/1980 Giardini ..... 123/30
4,364,342 A 12/1982 Asik ..... 123/143
4,369,758 A 1/1983 Endo ..... 123/620
4,504,964 A 3/1985 Cartz et al. ..... 378/119
4,507,588 A 3/1985 Asmussen et al. ..... 315/39
4,536,884 A 8/1985 Weiss et al. ..... 378/119
4,538,291 A 8/1985 Iwamatsu ..... 378/119
4,561,406 A 12/1985 Ward ..... 123/536
4,596,030 A 6/1986 Herziger et al. ..... 378/119
4,618,971 A 10/1986 Weiss et al. ..... 378/34
4,626,193 A 12/1986 Gann ..... 431/71
4,633,492 A 12/1986 Weiss et al. ..... 378/119
4,635,282 A 1/1987 Okada et al. ..... 378/34
4,751,723 A 6/1988 Gupta et al. ..... 378/119
4,752,946 A 6/1988 Gupta et al. ..... 378/119
4,774,914 A 10/1988 Ward ..... 123/162
4,837,794 A 6/1989 Riordan et al. ..... 378/119
4,928,020 A 5/1990 Birx et al. ..... 307/106
5,023,897 A 6/1991 Neff et al. ..... 378/122
5,027,076 A 6/1991 Horsley et al. ..... 324/674
5,102,776 A 4/1992 Hammer et al. ..... 430/311
5,126,638 A 6/1992 Dethlefsen ..... 315/326
5,142,166 A 8/1992 Birx ..... 307/419
5,171,360 A 12/1992 Orme et al. ..... 75/331
5,175,755 A 12/1992 Kumakhov ..... 378/34
5,226,948 A 7/1993 Orme et al. ..... 75/331
5,259,593 A 11/1993 Orme et al. ..... 266/78
5,313,481 A 5/1994 Cook et al. ..... 372/37
5,319,695 A 6/1994 Itoh et al. ..... 378/84
5,340,090 A 8/1994 Orme et al. ..... 266/202
RE34,806 E 12/1994 Cann ..... 427/446
5,411,224 A 5/1995 Dearman et al. ..... 244/53
5,448,580 A 9/1995 Birx et al. ..... 372/38
5,504,795 A 4/1996 McGeoch ..... 378/119
5,729,562 A 3/1998 Birx et al. ..... 372/38
5,763,930 A 6/1998 Partlo ..... 250/504
5,866,871 A 2/1999 Birx ..... 219/121
5,894,980 A 4/1999 Orme-Marmarelis et al. . 228/33
5,894,985 A 4/1999 Orme-Marmarelis et al. ..... 228/262
5,936,988 A 8/1999 Partlo et al. ..... 372/38
5,938,102 A 8/1999 Muntz et al. ..... 228/102
5,963,616 A 10/1999 Silfvast et al. ..... 378/122
5,970,076 A 10/1999 Hamada ..... 372/20
6,031,241 A 2/2000 Silfvast et al. ..... 250/504
6,031,598 A * 2/2000 Tichenor et al. ..... 355/67
6,039,850 A 3/2000 Schulz ..... 204/192.15
6,051,841 A 4/2000 Partlo ..... 250/504
6,064,072 A 5/2000 Partlo et al. ..... 250/504
6,172,324 B1 1/2001 Birx ..... 219/121.57
6,186,192 B1 2/2001 Orme-Marmarelis et al. . 141/18
6,195,272 B1 2/2001 Pascente ..... 363/21
6,224,180 B1 5/2001 Pham-Van-Diep et al. ..... 347/2
6,228,512 B1 5/2001 Bajt et al. ..... 428/635
6,264,090 B1 7/2001 Muntz et al. ..... 228/33
6,276,589 B1 8/2001 Watts, Jr. et al. ..... 228/33
6,285,743 B1 9/2001 Kondo et al. ..... 378/119
6,307,913 B1 * 10/2001 Foster et al. ..... 378/34
6,317,448 B1 11/2001 Das et al. ..... 372/32
6,377,651 B1 * 4/2002 Richardson et al. ..... 378/34
6,396,900 B1 5/2002 Barbee, Jr. et al. ..... 378/84
6,449,086 B1 9/2002 Singh ..... 359/361
6,452,194 B1 * 9/2002 Bijkerk et al. ..... 250/492.2
6,452,199 B1 9/2002 Partlo et al. ..... 250/504
6,491,737 B1 12/2002 Orme-Marmerelis et al. . 75/335
6,493,323 B1 12/2002 Dobrowolski et al. ..... 378/119
6,507,641 B1 * 1/2003 Sugisaki et al. ..... 378/119
6,520,402 B1 * 2/2003 Orme-Marmerelis et al. ..... 228/260
6,562,099 B1 * 5/2003 Orme-Marmerelis et al. . 75/335
6,566,667 B1 5/2003 Partlo et al. ..... 250/504
6,566,668 B1 5/2003 Rauch et al. ..... 250/504
6,576,912 B1 6/2003 Visser et al. ..... 250/492.2
6,580,517 B1 6/2003 Lokai et al. ..... 356/519
6,586,757 B1 * 7/2003 Melnychuk et al. .... 250/504 R
6,590,959 B1 7/2003 Kandaka et al. ..... 378/119
6,647,086 B1 11/2003 Amemiya et al. ..... 378/34
6,647,088 B1 * 11/2003 Schmidt et al. ..... 378/34
6,656,575 B1 12/2003 Bijkerk et al. ..... 428/212
6,724,462 B1 4/2004 Singh et al. ..... 355/53
6,744,060 B1 6/2004 Ness et al. ..... 315/111.01
6,744,851 B1 * 6/2004 Orsini et al. ..... 378/119
6,780,496 B1 8/2004 Bajt et al. ..... 425/216
6,804,327 B1 * 10/2004 Schriever et al. ..... 378/119
6,815,700 B1 * 11/2004 Melnychuk et al. .... 250/504 R
6,865,255 B1 * 3/2005 Richardson ..... 378/119
2001/0004104 A1 * 6/2001 Bijkerk et al. ..... 250/492.2
2003/0068012 A1 4/2003 Ahmad et al. ..... 378/119
2003/0196512 A1 10/2003 Wyszomierski et al. ..... 75/336
2003/0219056 A1 11/2003 Yager et al. ..... 372/57
2005/0253092 A1 * 11/2005 Zukavishvili et al. .... 250/492.2

OTHER PUBLICATIONS

Apruzese, J.P., "X-Ray Laser Research Using Z Pinches," *Am. Inst. of Phys.* 399-403, (1994).

Bal et al., "Sptimizing multiplayer coatings for Extreme UV projection systems," Faculty of Applied Sciences, Delft University of Technology.

Bollanti, et al., "Compact Three Electrodes Excimer Laser 1ANUS for a POPA Optical System," *SPIE Proc.* (2206)144-153, (1994).

Bollanti, et al., "Ianus, the three-electrode excimer laser," *App. Phys. B* (*Lasers & Optics*) 66(4):401-406, (1998).

Braun, et al., "Multi-component EUV Multilayer Mirrors," *Proc. SPIE,* 5037:2-13, (2003).

Choi, et al., "A $10^{13}$ A/s High Energy Density Micro Discharge Radiation Source," *B. Radiation Characteristics,* p. 287-290.

Choi, et al., "Fast pulsed hollow cathode capillary discharge device," *Rev. of Sci. Instrum.* 69(9):3118-3122 (1998).

Choi et al., Temporal development of hard and soft x-ray emission from a gas-puff Z pinch, *Rev. Sci. Instrum.* 57(8), pp. 2162-2164 (Aug. 1986).

Eckhardt, et al., "Influence of doping on the bulk diffusion of Li into Si(100)," *Surface Science* 319 (1994) 219-223.

Eichler, et al., "Phase conjugation for realizing lasers with diffraction limited beam quality and high average power," Techninische Universitat Berlin, Optisches Institut, (Jun. 1998).

Fedosejevs et al., "Subnanosecond pulses from a KrF Laser pumped $SF_6$ Brillouin Amplifier", *IEEE J. OE* 21, 1558-1562 (1985).

Feigl, et al., "Heat Resistance of EIJV Multilayer Mirrors for Long-time Applications," *Microelectric Engineering,* 57-58:3-8, (2001).

Fomenkov, et al., "Characterization of a 13.5nm Source for EUV Lithography based on a Dense Plasma Focus and Lithium Emission," Sematech Intl. Workshop on EUV Lithography (Oct. 1999).

Giordano et al., "Magnetic pulse compressor for prepulse discharge in spiker-sustainer excitati technique for XeCl lasers," *Rev. Sci. Instrum* 65(8), pp. 2475-2481 (Aug. 1994).

Hansson, et al., "Xenon liquid jet laser-plasma source for EUV lithography," Emerging Lithographic Technologies IV, *Proc. of SPIE*, vol. 3997:729-732 (2000).

Jahn, Physics of Electric Propulsion, McGraw-Hill Book Company, (Series in Missile and Space U.S.A.), Chap. 9, "Unsteady Electromagnetic Acceleration," p. 257 (1968).

Jiang, et al., "Compact multimode pumped erbium-doped phosphate fiber amplifiers," *Optical Engineering,* vol. 42, Issue 10, pp. 2817-2820 (Oct. 2003).

Kato Yasuo, "Electrode Lifetimes in a Plasma Focus Soft X-Ray Source," *J. Appl. Phys.* (33) Pt. 1, No. 8:4742-4744 (1991).

Kato, et al., "Plasma focus x-ray source for lithography," *Am. Vac. Sci. Tech. B.,* 6(1): 195-198 (1988).

Kuornrattanawanich, Ph.D. Dissertation, U.S. Department of Energy, Lawrence Livermore National Laboratory, Sep. 1, 2002.
Kloidt et al., "Enhancement of the reflectivity of Mo/Si multilayer x-ray mirrors by thermal treatment," *Appl. Phys. Lett.* 58(23), 2601-2603 (1991).
Kuwahara et al., "Short-pulse generation by saturated KrF laser amplification of a steep Stokes pulse produced by two-step stimulated Brillouin scattering", *J. Opt. Soc. Am.* B 17, 1943-1947 (2000).
Lange, Michael R., et al., "High gain coefficient phosphate glass fiber amplifer," NFOEC 2003, paper No. 126.
Lebert, et al., "Soft x-ray emission of laser-produced plasmas using a low-debris cryogenic nitrogen target," *J. App. Phys.,* 84(6):3419-3421 (1998).
Lebert, et al., "A gas discharged based radiation source for EUV-lithography," Intl. Conf. Micro and Nano-Engineering 98 (Sep. 22-24, 1998) Leuven, Belgium.
Lebert, et al., "Investigation of pinch plasmas with plasma parameters promising ASE," Inst. Phys. Conf. Ser No. 125: Section 9, pp. 411-415 (1992) Schiersee, Germany.
Lebert, et al., "Comparison of Laser produced and gas discharge based EUV sources for different applications," Intl. Conf. Micro- and Nano-Engineering 98 (Sep. 22-24, 1998) Leuven, Belgium.
Lee, Ja H., "Production of dense plasmas in hypocycloidal pinch apparatus," *The Phys. Of Fluids*, 20(2):313-321 (1977).
Lewis, Ciaran L.S., "Status of Collision-Pumped X-ray Lasers," *Am Inst. Phys.* pp. 9-16 (1994).
Lowe, "Gas plasmas yield X-rays for Lithography," *Electronics,* pp. 40-41 (Jan. 27, 1982).
Malmquist, et al., "Liquid-jet target for laser-plasma soft x-ray generation," *Am. Inst. Phys.* 67(12):4150-4153 (1996).
Mather, "Formation of a High-Density Deuterium Plasma Focus," *Physics of Fluids,* 8(2), 3660377 (Feb. 1965).
Mather, et al., "Stability of the Dense Plasma Focus," *Phys. Of Fluids,* 12(11):2343-2347 (1969).
Matthews and Cooper, "Plasma sources for x-ray lithography," *SPIE, vol. 333 Submicron Lithography,* pp. 136-139 (1982).
Mayo, et al., "A magnetized coaxial source facility for the generation of energetic plasma flows," *Sci. Technol.* vol. 4:pp. 47-55 (1994).
Mayo, et al., "Initial Results on high enthalpy plasma generation in a magnetized coaxial source," *Fusion Tech* vol. 26:1221-1225 (1994).
Mitsuyama, et al., "Compatibility of insulating ceramic materials with liquid breeders," *Fusion Eng. and Design* 39-40 (1998) 811-817.
Montclam et al., "Mo/Y multiplayer mirrors for the 8-12 nm wavelength region," *Optics Letters,* 19(15): 1173-1175 (Aug. 1, 1994).
Montcalm et al., "*In situ* reflectance measurements of soft-s-ray/extreme-ultraviolet Mo/Y multiplayer mirrors," *Optics Letters* 20(12): 1450-1452 (Jun. 15, 1995).
Nilsen et al., "Mo: Y multiplayer mirror technology utilized to image the near-field output of a Ni-like Sn laser at 11.9 nm," *Optics Letters*, 28(22) 2249-2251 (Nov. 15, 2003).
Nilsen, et al., "Analysis of resonantly photopumped Na-Ne x-ray-laser scheme," *Am Phys. Soc.* 44(7):4591-4597 (1991).
H. Nishioka et al., "UV saturable absorber for short-pulse KrF laser systems", *Opt. Lett.* 14, 692-694 (1989).
Orme, et al., "Electrostatic charging and deflection of nonconventional droplet streams formed from capillary stream breakup," *Physics of Fluids*, 12(9):2224-2235, (Sep. 2000).
Orme, et al., "Charged Molten Metal Droplet Deposition As a Direct Write Technology", MRS 2000 Spring Meeting, San Francisco, (Apr. 2000).
Pant, et al., "Behavior of expanding laser produced plasma in a magnetic filed," *Physica Sripta,* T75:104-111, (1998).
Partlo, et al., "EUV (13.5nm) Light Generation Using a Dense Plasma Focus Device," *SPIE Proc. On Emerging Lithographic Technologies III,* vol. 3676, 846-858 (Mar. 1999).
Pearlman et al., "X-ray lithography using a pulsed plasma source," *J. Vac. Sci. Technol.*, pp. 1190-1193 (Nov./Dec. 1981).
Pint et al., "High temperature compatibility issue for fusion reactor structural materials," Metals and Ceramics Division, Oak Ridge National Laboratory, P.O. Box 2008, Oak Ridge, TN 37831-6156.
Porter, et al., "Demonstration of Population Inversion by Resonant Photopumping in a Neon Gas Cell Irradiated by a Sodium Z Pinch," *Phys. Rev. Let.,* 68(6):796-799, (Feb. 1992).
Price, Robert H., "X-Ray Microscopy using Grazing indicence Reflection Optics," *Am. Inst. Phys.*, pp. 189-199, (1981).
Qi, et al., "Fluorescence in Mg LX emissiion at 48.340 Å from Mg pinch plasmas photopumped by Al XI line radiation at 48.338 Å," *The Am. Phys. Soc.,* 47(3):2253-2263 (Mar. 1993).
Sae-Lao et al., "Performance of normal-incidence molybdenum-yttrium multilayer-coated diffration grating at a wavelength of 9 nm," *Applied Optics*, 41(13):2394-1400 (May 1, 2002).
Sae-Lao et al., "Molybdenum-strontium multiplayer mirrors for the 8-12-nm extreme-ultraviolet wavelength region," *Optics Letters,* 26(7):468-470, (Apr. 1, 2001).
Sae-Lao et al., "Normal-incidence multiplayer mirrors for the 8-12 nm wavelength region," Information Science and Technology, Lawrence Livermore National Laboratory.
Sae-Lao et al., "Measurements of the refractive index of ytrrium in the 50-1300-eV energy region," *Applied Optics,* 41(34):7309-7316 (Dec. 1, 2002).
Scheuer, et al., "A Magnetically-Nozzled, Quasi-Steady, Multimegawatt, Coaxial Plasma Thruster," *IEEE: Transactions on Plasma Science,* 22(6) (Dec. 1994).
S. Schiemann et al., "Efficient temporal compression of coherent nanosecond pulses in a compact SBS generator-amplifier setup", *IEEE J. OE* 33, 358-366 (1997).
Schriever, et al., "Laser-produced lithium plasma as a narrow-band extended ultraviolet radiation source for photoelectron spectroscopy," *App. Optics,* 37(7):1243-1248, (Mar. 1998).
Schriever, et al., "Narrowband laser produced extreme ultraviolet sources adapted to silicon/molybdenum multilayer optics," *J. of App. Phys.*, 83(9):4566-4571, (May 1998).
Sharafat et al., Coolant Structural Materials Compatibility, Joint APEX Electronic Meeting, UCLA, (Mar. 24, 2000).
Shiloh et al., "Z Pinch of a Gas Jet," *Physical Review Lett.*, 40(8), pp. 515-518 (Feb. 20, 1978).
Silfvast, et al., "High-power plasma discharge source at 13.5 nm and 11.4 nm for EUV lithography," *SPIE,* vol. 3676:272-275, (Mar. 1999).
Silfvast, et al., "Lithium hydride capillary discharge creates x-ray plasma at 13.5 nanometers," *Laser Focus World,* p. 13. (Mar. 1997).
Singh et al., "Improved Theoretical Reflectivities of Extreme Ultraviolet Mirrorw," Optics Research Group, Faculty of Applied Sciences, Delft University of Technology.
Singh et al., "Design of multiplayer extreme-ultraviolet mirrors for enhanced reflectivity," *Applied Optics,* 39(13):2189-2197 (May 1, 2000).
Soufli, et al., "Absolute photoabsorption measurements of molybdenum in the range 60-930 eV for optical constant determination," *Applied Optics* 37(10): 1713-1719 (Apr. 1, 1998).
Srivastava et al., "High-temperature studies on Mo-Si multilayers using transmission electron microscope," *Current Science,* 83 (*):997-1000 (Oct. 25, 2002).
Stallings et al., "Imploding argon plasma experiments," *Appl. Phys. Lett.*, 35(7), pp. 524-526 (Oct. 1, 1979).
Takahashi, E., et al., "KrF laser picosecond pulse source by stimulated scattering processes", *Opt. Commun.* 215, 163-167 (2003).
Takabashi, E., et al., "High-intensity short KrF laser-pulse generation by saturated amplification of truncated leading-edge pulse", *Opt. Commun.* 185, 431-437 (2000).
Takenaka, et al., "Heat resistance of Mo/Si, $MoSi_2$/Si, and $Mo_5Si_3$/Si multiplayer soft x-ray mirrors," *J. Appl. Phys.* 78(9) 5227-5230 (Nov. 1, 1995).
Tillack, et al., "Magnetic Confinement of an Expanding Laser-Produced Plasma", UC San Diego, Center for Energy Research, UCSD Report & Abramova—Tornado Trap.
Wilhein, et al., "A slit grating spectrograph for quantitative soft x-ray spectroscopy," *Am. Inst. Of Phys. Rev. of Sci. Instrum.*, 70(3):1694-1699, (Mar. 1999).
Wu, et al., "The vacuum Spark and Spherical Pinch X-ray/EUV Point Sources," *SPIE, Conf. On Emerging Tech. III,* Santa Clara, CA, vol. 3676:410-420, (Mar. 1999).
Zombeck, M. V., "Astrophysical Observations with High Resolution X-ray Telescope," *Am. Inst. Of Phys.,* pp. 200-209, (1981).

* cited by examiner

METHOD AND APPARATUS FOR EUV LIGHT SOURCE TARGET MATERIAL HANDLING

RELATED APPLICATIONS

The present application is a continuation in part of U.S. patent application Ser. No. 11/067,124, entitled METHOD AND APPARATUS FOR EUV PLASMA SOURCE TARGET DELIVERY, filed Feb. 25, 2005, the disclosures of each of which is also hereby incorporated by reference.

The present application is related to co-pending U.S. application Ser. No. 11/021,261, entitled EUV LIGHT SOURCE OPTICAL ELEMENTS, filed on Dec. 22, 2004, and Ser. No. 10/979,945, entitled EUV COLLECTOR DEBRIS MANAGEMENT, filed on Nov. 1, 2004, Ser. No. 10/979,919, filed on Nov. 1, 2004, entitled LPP EUV LIGHT SOURCE, Ser. No., 10/900,839, entitled EUV LIGHT SOURCE, Ser. No. 10/798,740, entitled COLLECTOR FOR EUV LIGHT SOURCE, the disclosures of which are hereby incorporated by reference.

FIELD OF THE INVENTION

The present invention related to laser produced plasma ("LPP") extreme ultraviolet ("EUV") light sources using plasma source material in the form of liquid metal and more specifically to systems for handling and delivering the liquid metal to a target formation mechanism.

BACKGROUND OF THE INVENTION

It is known in the art to generate EUV light from the production of a plasma of an EUV source material which plasma may be created by a laser beam irradiating the target material at a plasma initiation site (i.e., Laser Produced Plasma, "LPP") or may be created by a discharge between electrodes forming a plasma, e.g., at a plasma focus or plasma pinch site (i.e., Discharge Produced Plasma "DPP") and with a target material delivered to such a site at the time of the discharge. Target delivery in the form of droplets of plasma source material, which may, e.g., be mass limited for better plasma generation conversion efficiency and lower debris formation, are known techniques for placing the plasma source material at the appropriate location and at the appropriate time for the formation of the plasma either by LPP or DPP. A number of problems are known to exist in the art regarding the handling of the target material, e.g., liquid metal feeding to a mechanism for the formation of target droplets either of the metal itself or a suspension, dispersion or other mixture of the target material with a liquid that is not reactive with the target material, e.g., water or alcohol for a tin metal plasma source material and a liquid plasma source material compound such as $Li(CH_3)$. The present applications relates to aspects of embodiments of methods and apparatus for dealing with such problems.

Complex liquid metal handling systems are found in certain liquid metal cooled nuclear reactors, as wall protection in experimental fusion reactors and for use with targets in high energy particle accelerators.

SUMMARY OF THE INVENTION

An EUV light source plasma source material handling system and method is disclosed which may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is on line; a transfer mechanism transferring liquid plasma source material from the supply reservoir to the droplet generator plasma source material reservoir, while the droplet generator is on line. The transfer mechanism may comprise a conduit interconnecting the supply reservoir and the droplet generator plasma source material reservoir. The transfer mechanism may comprise a valve isolating the supply reservoir from the droplet generator plasma source material reservoir. The supply reservoir may comprise a solid form of the plasma source material used to periodically form from a portion of the material in solid form the material in liquid form. The transfer mechanism may comprise a heater mechanism operative to apply heat primarily to a surface of the solid form of the plasma source material. The transfer mechanism may comprise a heat actuated valve between the supply reservoir and the droplet generator plasma source material reservoir. The apparatus and method may comprise a displaced heater mechanism disposed above a molten material gathering region of the supply reservoir operative to apply heat to a solid form of the plasma source material in the vicinity of the displaced heater mechanism. The apparatus and method may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is on line; a transfer mechanism transferring liquid plasma source material from the supply reservoir to the droplet generator plasma source material reservoir, while the droplet generator is on line, a discharge end of the transfer mechanism positioned below the upper surface of the droplet generator plasma source material in the droplet generator plasma source material reservoir during such transferring. The apparatus and method may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir displaced above the droplet generator plasma source material reservoir, in fluid communication with the droplet generator plasma source material reservoir and holding at least a replenishing amount of plasma source material in liquid form for transfer to the droplet generator plasma source material reservoir, while the droplet generator is on line; a transfer mechanism transferring liquid plasma source material from the supply reservoir to the droplet generator plasma source material reservoir, while the droplet generator is on line. The apparatus and method may comprise a liquid plasma source material handling controller maintaining a level of droplet generator plasma source material in the droplet generator plasma source reservoir based upon the sensing of the level of the droplet generator plasma source material in the droplet generator plasma source material reservoir and the sensing of a level of liquid plasma source material in the supply reservoir. The apparatus and method may comprise the controller controlling a heating mechanism heating at least one surface of a solid form of the plasma source material in the supply reservoir prior to the transferring in response to a sensing of the level of liquid plasma source material in the supply reservoir. The apparatus and method may comprise the controller controlling the heating of at least one surface of a solid form of plasma source material in the supply reservoir after the transferring responsive to the sensing of a level of liquid plasma source material in the supply reservoir.

The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, comprising the steps of: utilizing an initial cleaning and conditioning process to achieve stable long-term performance, due to initial contamination due to liquid metal and plasma source material handling system component chemical interaction by providing an initial flush of the system. The flush is carried out at a selected temperature and introduced in sufficient quantity to avoid clogging. The method and apparatus may comprise subjecting plasma source material handling system component surfaces in contact with the plasma source material to a passivation process. The passivation material may comprise an acid bath to leech out materials through the component surfaces reactive with molten plasma source material. The method and apparatus may comprise choosing materials for surfaces wetted by the liquid plasma source material to substantially limit the formation of intermetallic compounds by the wetted surface material and the liquid plasma source material. The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, which may comprise the steps of: utilizing an inline filter intermediate the plasma source material supply system and the droplet generator plasma source material reservoir to prevent contaminants in the plasma source material reservoir from reaching the droplet generator plasma source material reservoir. The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, which may comprise the steps of: maintaining temperatures in at least one selected portion of the material handling system so as to avoid thermal gradients within the at least one selected portion sufficient to cause solubility differences sufficient to precipitate out insoluble compounds as particulate. The method and apparatus may comprise maintaining at least one selected portion of the material handling system downstream of a valve in the transfer mechanism at an elevated temperature sufficient to avoid blockage of at lest one narrowed passage portion of the at least one selected portion. The at least one selected portion is selected from the capillary, a nozzle at the discharge end of the capillary and an output orifice in the nozzle. The method and apparatus may comprise an EUV light source plasma source material handling system which may comprise: a droplet generator having a droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator at temperature; a storage mechanism storing plasma source material in a solid form within the droplet generator plasma source material supply system to replenish the plasma source material in the molten portion of the supply system reservoir. the method and apparatus may comprise a porous separator separating a solid form storage portion of the plasma source material supply system reservoir from the molten plasma source material supply system reservoir; a heating mechanism heating the porous separator to inject liquid plasma source material into the molten portion of the plasma source material supply system reservoir by melting at least a portion of the solid form of the plasma source material. The method and apparatus may comprise a hopper in the plasma source material supply system reservoir containing plasma source material in a solid dispensable form comprising a remotely operated dispensing mechanism delivering a selected quantity of the solid dispensable plasma source material to the molten plasma material portion of the plasma source material supply system reservoir. The dispensable form may comprise a pellet form or a powder form. The apparatus and method may comprise a holding mechanism holding the solid form plasma source material separate from the molten portion of the plasma source material supply system reservoir; a segmented heating mechanism selectively heating a selected segment of the solid form plasma source material in the plasma source material supply system reservoir to replenish the liquid form plasma source material in the molten portion of the plasma source material supply system reservoir.

DETAILED DESCRIPTION OF PREFERRED EMBODIMENTS

Figure 1:
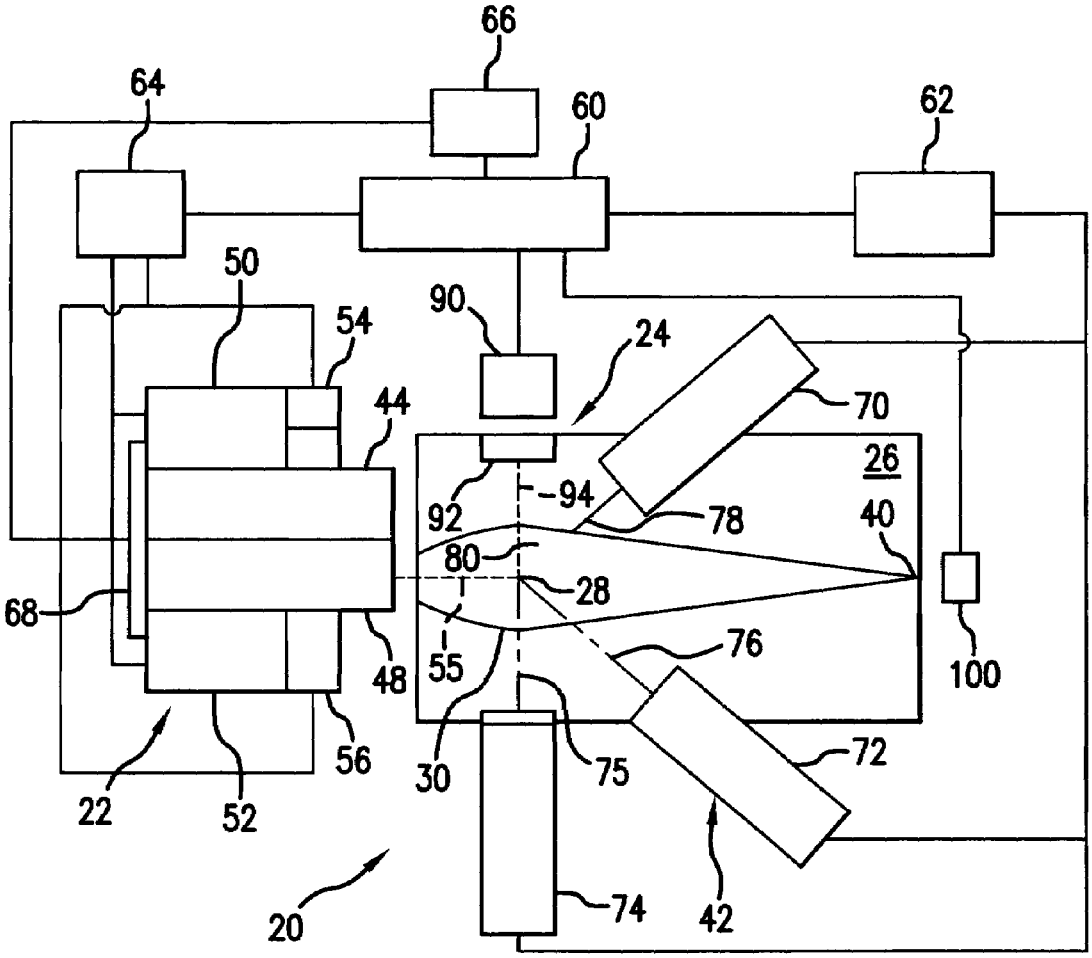
FIG. 1 shows schematically in block diagram form an EUV light source using LPP and target source material in the form of droplets of liquid according to aspects of an embodiment of the present invention.

Turning now to FIG. 1 there is shown a schematic view of an overall broad conception for an EUV light source, e.g., a laser produced plasma EUV light source 20 according to an aspect of the present invention. The light source 20 may contain a pulsed laser system 22, e.g., one or more gas discharge excimer or molecular fluorine lasers operating at high power and high pulse repetition rate and may be one or more MOPA configured laser systems, e.g., as shown in U.S. Pat. Nos. 6,625,191, 6,549,551, and 6,567,450. The light source 20 may also include a target delivery system 24, e.g., delivering targets in the form of liquid droplets, solid particles or solid particles contained within liquid droplets. The targets may be delivered by the target delivery system 24, e.g., into the interior of a chamber 26 to an irradiation site 28, otherwise known as an plasma formation site or the sight of the fire ball, i.e., where irradiation by the laser causes the plasma to form from the target material. Embodiments of the target delivery system 24 are described in more detail below.

Laser pulses delivered from the pulsed laser system 22 along a laser optical axis 55 (or plurality of axes, not shown in FIG. 1) through a window (not shown) in the chamber 26 to the irradiation site, suitably focused, as discussed in more detail below, and in above referenced co-pending applications, in coordination with the arrival of a target produced by the target delivery system 24 to create an EUV or soft-x-ray (e.g., at or about 13.5 nm) releasing plasma, having certain characteristics, including wavelength of the x-ray light produced, type and amount of debris released from the plasma during or after plasma initiation, according to the material of the target, the size and shape of the target, the focus of the laser beam and the timing and location of the laser beam and target at the plasma initiation site, etc.

The light source may also include a collector 30, e.g., a reflector, e.g., in the form of a truncated ellipse, with an aperture for the laser light to enter to the irradiation site 28. Embodiments of the collector system are described in more detail below and in above referenced co-pending applications. The collector 30 may be, e.g., an elliptical mirror that has a first focus at the plasma initiation site 28 and a second focus at the so-called intermediate point 40 (also called the intermediate focus 40) where the EUV light is output from the light source and input to, e.g., an integrated circuit lithography tool (not shown). The system 20 may also include a target position detection system 42. The pulsed system 22 may include, e.g., a master oscillator-power amplifier ("MOPA") configured dual chambered gas discharge laser system having, e.g., an oscillator laser system 44 and an amplifier laser system 48, with, e.g., a magnetic reactor-switched pulse compression and timing circuit 50 for the oscillator laser system 44 and a magnetic reactor-switched pulse compression and timing circuit 52 for the amplifier laser system 48, along with a pulse power timing monitoring system 54 for the oscillator laser system 44 and a pulse power timing monitoring system 56 for the amplifier laser system 48. The system 20 may also include an EUV light source controller system 60, which may also include, e.g., a target position detection feedback system 62 and a firing control system 64, along with, e.g., a laser beam positioning system 66.

The target position detection system 42 may include a plurality of droplet imagers 70, 72 and 74 that provide input relative to the position of a target droplet, e.g., relative to the plasma initiation site, and provide these inputs to the target position detection feedback system, which can, e.g., compute a target position and trajectory, from which a target error can be computed, if not on a droplet by droplet basis then on average, which is then provided as an input to the system controller 60, which can, e.g., provide a laser position and direction correction signal, e.g., to the laser beam positioning system 66 that the laser beam positioning system can use, e.g., to control the position and direction of the laser position and direction changer 68, e.g., to change the focus point of the laser beam to a different ignition point 28. Input may also be provided to the target delivery system 24 to correct for positioning error of the targets, e.g., droplets of liquid plasma source material from the desired plasma initiation site, e.g., at one focus of the collector 30.

The imager 72 may, e.g., be aimed along an imaging line 75, e.g., aligned with a desired trajectory path of a target droplet 94 from the target delivery mechanism 92 to the desired plasma initiation site 28 and the imagers 74 and 76 may, e.g., be aimed along intersecting imaging lines 76 and 78 that intersect, e.g., along the desired trajectory path at some point 80 along the path before the desired ignition site 28. other alternatives are discussed in above referenced co-pending applications.

The target delivery control system 90, in response to a signal from the system controller 60 may, e.g., modify, e.g., the release point and/or pointing direction of the target droplets 94 as released by the target delivery mechanism 92 to correct for errors in the target droplets arriving at the desired plasma initiation site 28.

An EUV light source detector 100 at or near the intermediate focus 40 may also provide feedback to the system controller 60 that can be, e.g., indicative of the errors in such things as the timing and focus of the laser pulses to properly intercept the target droplets in the right place and time for effective and efficient LPP EUV light production.

According to aspects of an embodiment of the present invention applicants propose to improve droplet generator run time by way of, e.g., increasing material storage capacity. Applicants propose a melt on demand system to cut down on the molten storage of liquid metal for plasma source target droplet material, such as liquid tin or liquid lithium. In addition to volume storage requirements a large volume of liquid metal stored for usage in target droplet formation raises problems of heating to maintain the volume as a liquid and other related problems which will be understood by those skilled in the art, including also the need for operator interaction with the system to maintain the material and dross and slag buildup and potential for clogging relatively small openings in the target material handling and delivery system.

By way of example a prototype tin droplet generator tested by applicants assignee Cymer was found to have a finite run time of approximately 3–4 hours at a droplet formation rate of 24,000/second. Refilling the prototype generator was found to require a substantial amount of time for cool down, disassembly, reassembly, and reheat. Increasing the generator chamber volume may work to resolve these operating efficiency issues, however, the ability to do this is limited, e.g., by the static head that develops, in addition to other problems noted above. Static head may induce dribbling and inhibit rapid shut off of the droplet formation by the droplet generator.

According to aspects of an embodiment of the present invention applicants propose a target material handling system 110 including a bulk material reservoir 112 as shown partly schematically and partly in cross section in FIG.'s 2 and 3 that enables the operator to refill a reservoir 114 in the target droplet generator 92 with minimal down time and effort.

The droplet generator 92 reservoir chamber 114 may be coupled to a second, bulk reservoir chamber 112 chamber, e.g., through a valve 120. Both chambers 112, 114 may be closed volume with independent, active pressure control systems (not shown). In such a system, the operator may fill the bulk reservoir chamber 112, closes the lid 116, heat up the plasma source metal material to get it into the liquid form, open the valve 120, e.g., by heating a pipe 122 between the chambers 112, 114 with a heater 124, to form a liquid metal in the pipe 122 and then depressurize the chamber 114 and pressurize the chamber 112 (or otherwise pressurize the chamber 112 more than the chamber 114) to fill the target generator 92 chamber 114 from the bulk reservoir chamber 112. Periodic refilling of bulk chamber is required, e.g., when a low level is detected by a level detector 130 in the target droplet generator chamber 112 but can be done while droplet generator is hot thus saving time. However, the bulk chamber still requires periodic refilling which can inconvenience the operator depending upon frequency and type of material used. For example, Lithium poses some special problems due to its reactivity, requiring, e.g., that it be handled in an inert environment. The larger the bulk chamber 114, the longer the time between refills. Unfortunately, there are a number of required tradeoffs for using such a jumbo bulk reservoir chamber 112, e.g., the large mass of molten metal in bulk reservoir can, e.g., produce large amounts of slag/dross thus affecting yield and possibly run time; a large static head will form and may result in overfilling of generator reservoir and other problems noted above; and a short and wide chamber can be used to minimize the static head but will maximize slag/dross formation due to the large surface area. Further, prolonged heat and cool down time is required, since, e.g., the bulk chamber must be cool when refilling to protect operator and maintain high purity.

According to aspects of an embodiment of the present invention, applicants propose a bulk reservoir system 118 that can minimize operator interaction, e.g., minimize the frequency of required refills and at the same time avoid the problems of too large a reservoir chamber 112. According to aspects of an embodiment of the present invention applicants propose a bulk reservoir system 118 that can be utilized for a long period of time, e.g., up to six months or more to supply, e.g., lithium, and freeing the user from the task of refilling the bulk reservoir 112 more often. The bulk reservoir 112 can, e.g., be filled with, e.g., lithium at the manufacturer, e.g., in a more controlled environment than, e.g., a semiconductor microlithography fabrication facility and transported to the facility to replace a used bulk reservoir system 118, thereby reducing the problems of handling a highly reactive target source material such as lithium in a heated and liquid form, such as reacting with ambient materials in the users fabrication facility causing, e.g., contamination in what are intended to be highly contaminant free environments. Alternatively, when the plasma source target material runs out, the entire droplet generator system 110, with the bulk reservoir system 118 and the droplet generator 92 may be replaced with new units.

According to aspects of an embodiment of the present invention applicants propose a "Melt on Demand" bulk reservoir 112 feed system which may include, e.g., heating only the bottom of a solid piece 140 of plasma source target material thereby producing a small quantity of melt 142. The level sensor 132 can detect when the melt volume 144 in the droplet generator 92 reaches a minimum level. At this time, the chamber valve 120 can be opened and molten metal 142 conveyed from the bulk reservoir chamber 112 to the to the droplet generator chamber 114.

The target delivery control system 90 may receive inputs from the level sensors 130, 132 and control the heaters, e.g., bottom heaters 150 to melt a given amount of the solid material 140, e.g., until the level sensor 132 indicate a given amount of liquid material 142 exists in the bulk reservoir 112 and also the heaters 124 to open the valve, or otherwise initiate fluid communication between the reservoir 112 and the reservoir 114, e.g., with another type of valve (not shown) to allow the newly formed and/or re-melted material 142 in the bulk reservoir 112, during or after which the bottom heaters may be turned off, such that the solid material 140 ceases to melt and if there is liquid material 142 left in the reservoir 112 is may also solidify after some time. The bottom heaters 150 and the valve 120 heaters may be turned off until the next call for material by the controller 90. The heaters 160 around the droplet generator reservoir 114 may be kept continuously on by the controller 90 or cycled by the controller 90 as necessary to maintain the temperature of the plasma source material 144 within some selected range to keep it molten in the droplet generator reservoir 114. The molten material 142 may be essentially all drained from the reservoir 112 and the bottom heaters 150 turned off by the controller 90. At the next replenishment, the heaters 150 may be turned on and the level sensor 132 used to indicated a desired amount of molten material 142 has been created prior to opening the valve 120 to drain essentially all of this molten material 142 into the reservoir 114 and then the heaters 150 may again be turned off to await the next needed replenishment of the reservoir 114.

The molten material 144 may then be forced, e.g., under pressure through a capillary 164 which may be actuated by a piezoelectric actuator 162 under the control of the controller 90 to form droplets 94 at the output orifice 168 of a nozzle 166 including the capillary 164.

Figure 3:
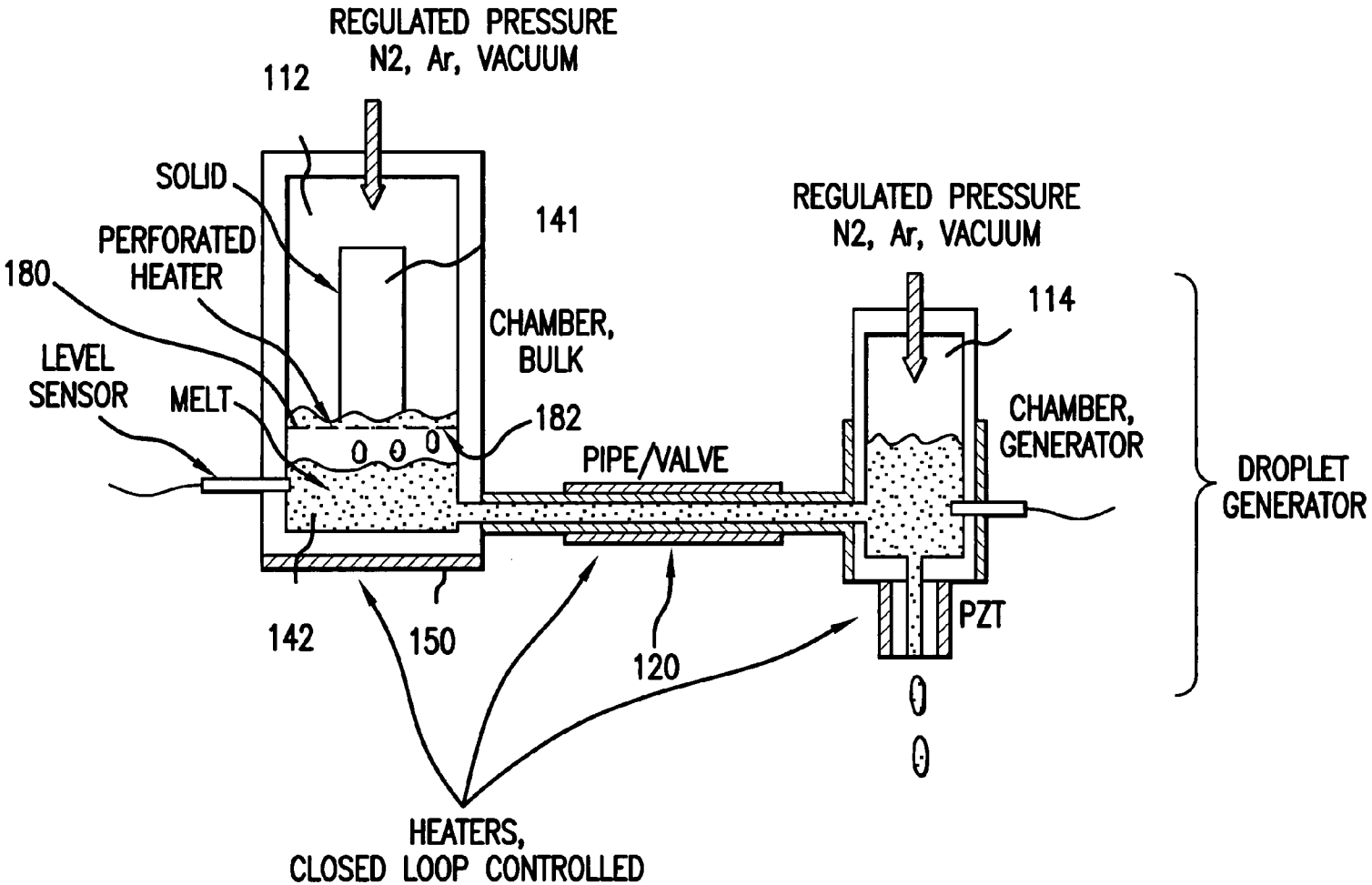
FIG. 3 shows partly schematically and partly in cross section a liquid droplet plasma source material handling system according to aspects of an embodiment of the present invention.

Alternatively, according to aspects of an embodiment of the present invention, as shown by way of example in FIG. 3 a perforated heater 180 formed, e.g., by a wire mesh having openings 182 may be used to melt the solid material 140 above the molten material. This may be utilized in a variety of ways under the control of the controller 90, e.g., the bottom heaters 150 may be kept on continuously or cycled to keep molten material 142 in the bulk reservoir chamber 112 until needed to be transferred to the droplet generator reservoir chamber 114, after which time the valve 120 may be closed off and the heater 180 used to replenish the supply of molten material 142 in the bulk reservoir 112. Also, the molten material 142 may be essentially completely drained from the bulk reservoir 112 at each replenishment controlled by the controller 90 after which, when a next replenishment is needed the heaters 180 may be actuated to create sufficient molten material 142, which may be assisted in being kept molten by bottom heaters 150 (or bottom heaters 150 may be eliminated) and the molten material 142 drained through the valve 120 into the chamber 114.

Figure 4:
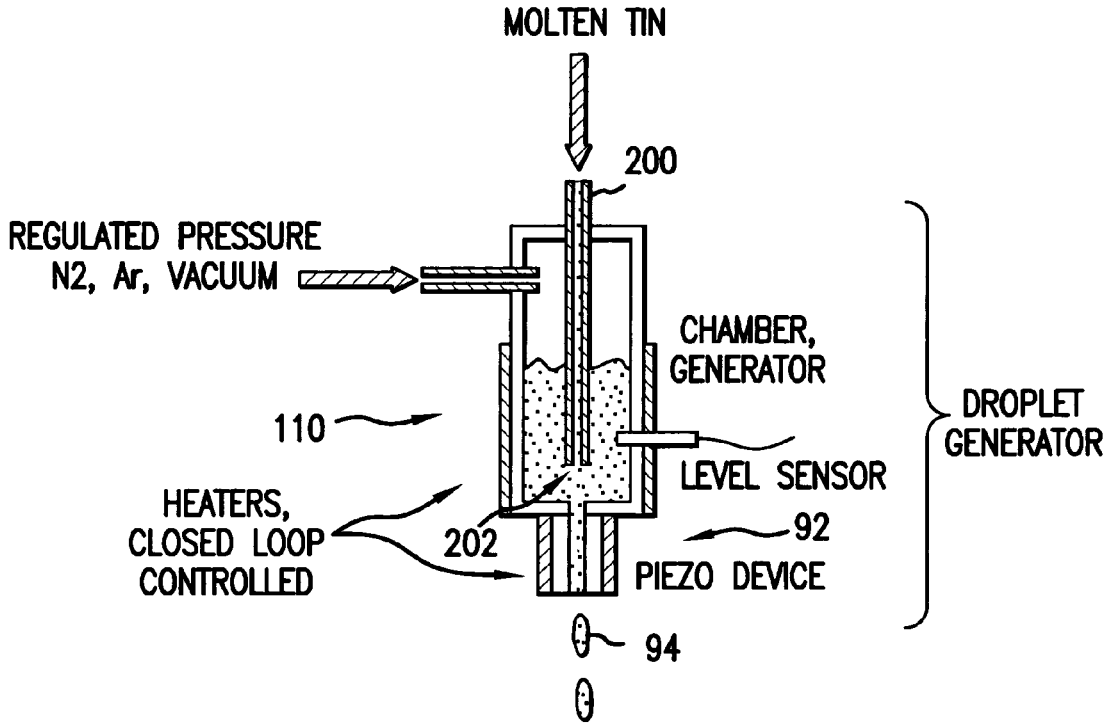
FIG. 4 shows partly schematically and partly in cross section a liquid droplet plasma source material handling system according to aspects of an embodiment of the present invention.
Figure 5:
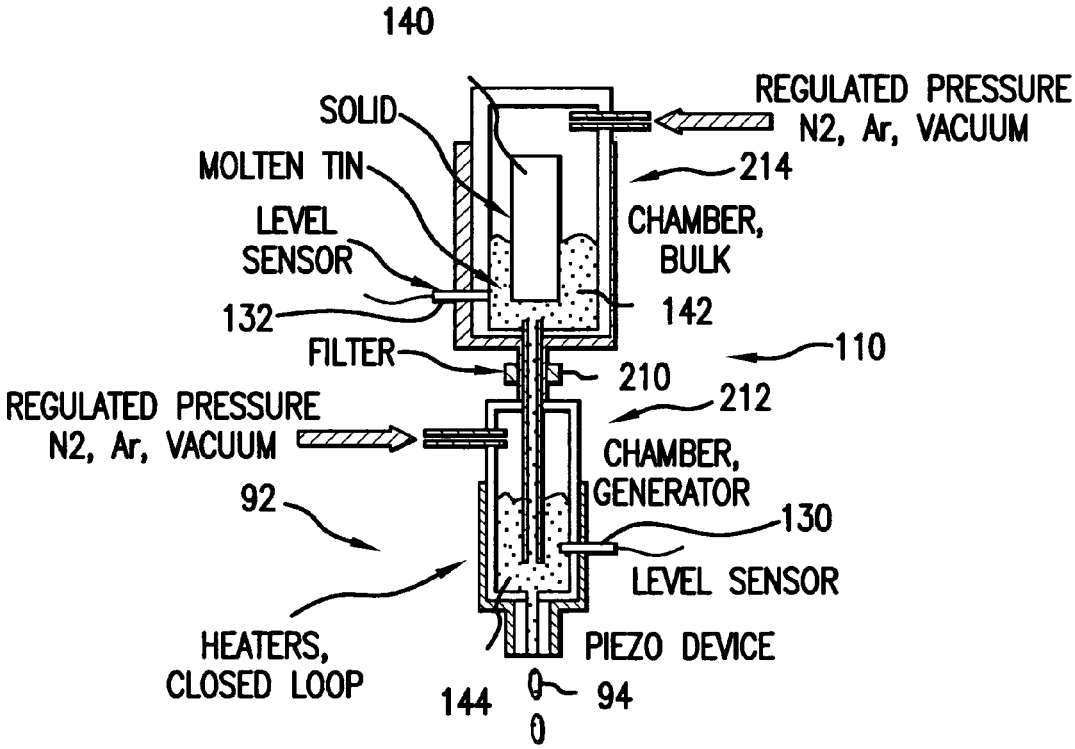
FIG. 5 shows partly schematically and partly in cross section a liquid droplet plasma source material handling system according to aspects of an embodiment of the present invention.

According to aspects of an embodiment of the present invention applicants propose a solution to the slag build up/crust formation, e.g., on the surface of the liquid material 144 in the droplet generator 92 reservoir 114, e.g., to enable more extended operation using refilling, e.g., from a bulk plasma source material reservoir system 114. Applicants propose as illustrated partly schematically and partly in cross section in FIG. 4 to allow replenishment of, e.g., the liquid metal 144 in the reservoir 114 with minimal buildup of slag/crust and also to limit the impact of formed slag/crust. The crust can otherwise clog filters and potentially the nozzle. Turning to FIG. 4 there is shown an embodiment including, e.g., instead of filling the reservoir from the top, so that newly added material can reside on the slag/crust the vessel chamber 114 can be filled from the middle through a tube 200. This arrangement has several advantages, e.g., any formed top slag/crust will have great difficulty in reaching the nozzle 166 as shown in FIG. 4 or the filter 210 region as shown in the embodiment of FIG. 5, since as the supply is replenished from the bottom. Furthermore the formed crust will not get buried in new material and act as a barrier between the old and new material. Also, since the material being added is never exposed to the atmosphere less contamination is introduced.

Figure 2:
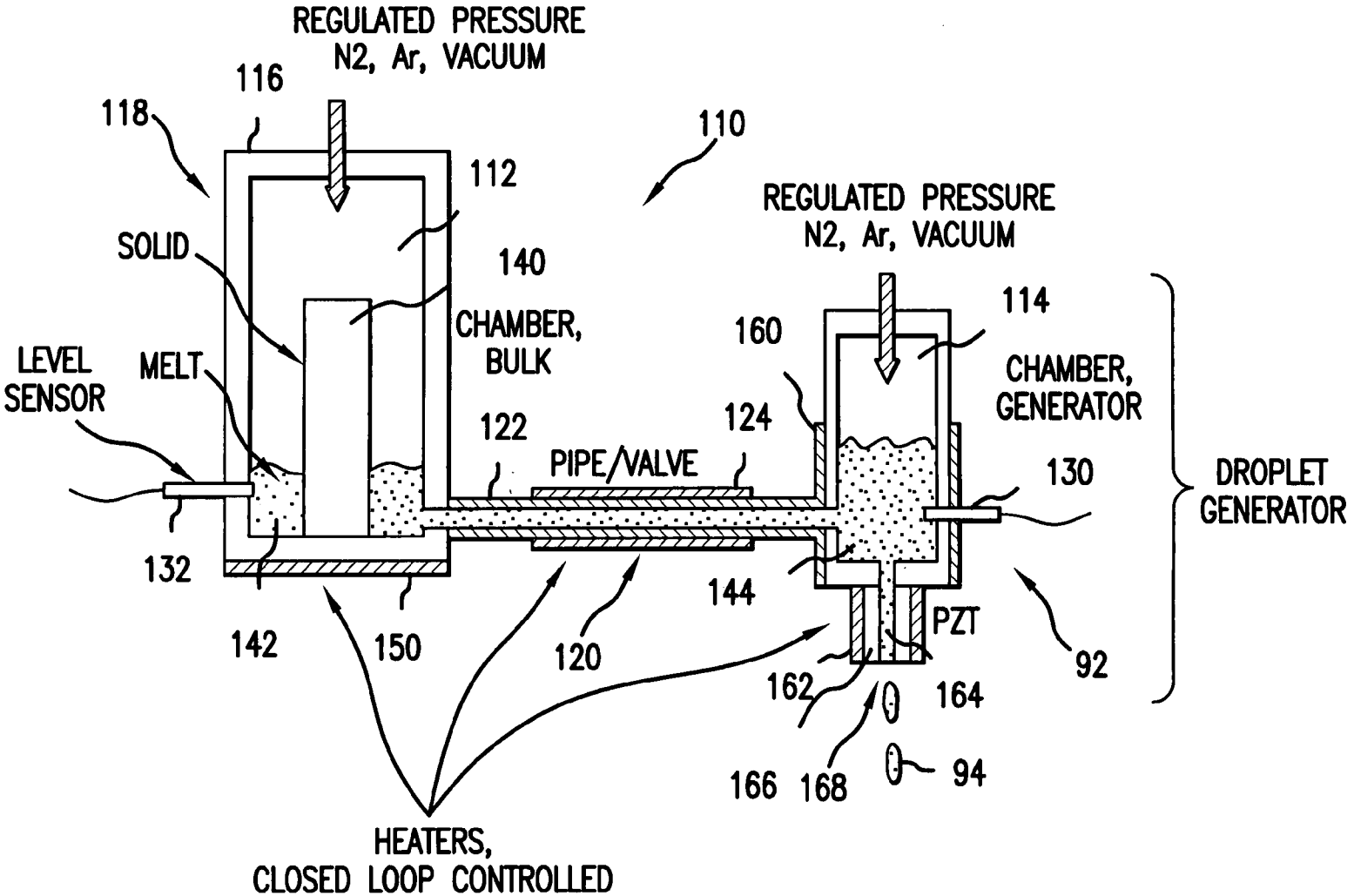
FIG. 2 shows partly schematically and partly in cross section a liquid droplet plasma source material handling system according to aspects of an embodiment of the present invention.

According to aspects of an embodiment of the present invention applicants propose to utilize the advantages of a multi-vessel system for online and in situ refilling and slag reduction. This can, e.g., extend the run time of a liquid metal jetting system as well as increase the purity of the jetted material and decrease the build up of slag in the liquid metal reservoir 114 in the target droplet generator used for jetting. In FIG. 5 there is shown a liquid metal handling system 110 comprising more than one vessel of liquid metal 142 and 144. FIG. 5 depicts partly schematically and partly in cross section a two-vessel arrangement where the lower vessel 212 is used for jetting and is replenished from an upper vessel 214. By utilizing, e.g., a valve (mechanical or freeze) (not shown, but can be, e.g., incorporated into the filter assembly 210) between the two vessels 212, 214, one of the advantages of this multi-vessel configuration is that the upper vessel 214, like the bulk reservoir vessels in FIGS. 2 and 3, can be refilled, vented, etc., while running the lower vessel 212 to allow essentially uninterrupted operation of the droplet forming jet. Also filling the second/lower vessel 212 with liquid, filtered metal reduces the amount of contaminations and allows longer and more stable operation. A single vessel system cannot normally operate for extended periods of time due to its limited volume. The volume will be limited by practical considerations noted above, including the maximum allowed static head before, e.g., self-jetting occurs. Complex liquid metal handling systems are found in certain liquid metal cooled nuclear reactors, as wall protection in experimental fusion reactors, and as targets in high energy particle accelerators. However, applicants are unaware of uses similar to the multi vessel arrangement as proposed herein for plasma source material target delivery.

According to aspects of an embodiment of the present invention applicants propose methods and apparatus of the successful jetting of plasma source material in liquid form, e.g., molten lithium or tin through the use of proper design and initial conditioning of the jetting hardware, in order to achieve stable, non-clogging jetting of liquid metals through a microscopic orifice, e.g., about one μm in diameter.

Applicants propose a hardware requirement coupled with an initial cleaning and conditioning process to achieve stable long-term performance from a jetting device 92. In addition to an inline filter 210 such as that shown in FIG. 5 or in co-pending applications referenced above, e.g., to prevent initial particles and/or larger contaminants formed over time in the up stream reservoir, e.g., 214, e.g., lithium or tin or compounds thereof, applicants to overcome initial contamination due to liquid metal and wall interaction etc by providing an initial flush of the system 110, e.g., at a selected temperature through a sufficiently large orifice (not shown) to avoid clogging and for an extended period of time using an extensive amount of material. For example one can replace the usual output orifice of about 50 μm with a relatively much larger one, e.g., about 250 μm allowing for a more rapid flush and one with a higher flush velocity than with the normal orifice size and thus more effectively and efficiently flush the entire system. This in effect allows for a flush equivalent to several ours of actual operation with essentially the same amount of material flushing the system as would pass through the system during those several hours of actual operation with the normal sized output orifice.

In the case of liquid tin using stainless vessels and parts, these will need, e.g., to be passivated, e.g., in an acid bath to leech out impurities, e.g., iron from the outer layers of the stainless. Such can otherwise dissolve in the tin and eventually form tin iron intermetallic compounds that are large enough to disturb or completely clog the output orifice 168. As a general rule the materials wetted by the liquid plasma source material 142, 144 should be chosen to limit or eliminate the intermetallic compounds that exist, e.g., for tin, metals, e.g., molybdenum, tantalum or tungsten alloy can be used and for lithium, perhaps also molybdenum, tantalum or tungsten.

Further, the temperature of the system should be constant throughout normal operation (and in time) to within ±2° C., to avoid thermal gradients that can drive solubility differences and compound the problems with impurities and/or leeching products concentrating to the point where they exceed the solubility limit and become particulate. Applicants believe that certain critical parts (i.e. the nozzle 166 and/or the capillary 164 and/or the output orifice 168 and any parts downstream of the filters) could be intentionally held at a hotter temperature, e.g., about 25° C., but not the other way around. As a general rule the colder the better as essentially all reaction rates and solubility limits increase with temperature.

Figure 6:
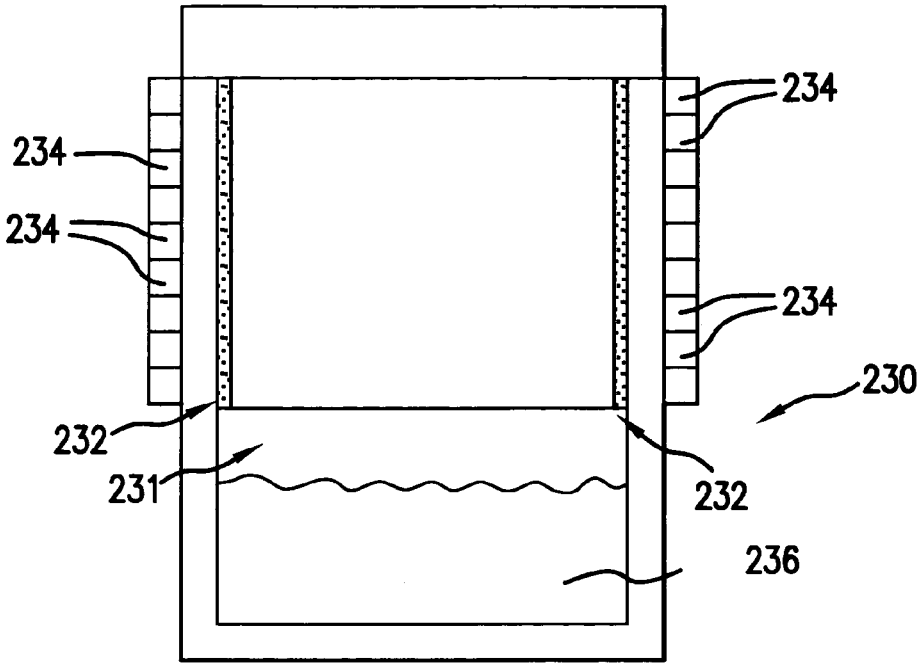
FIG. 6 shows schematically and partly in cross section a liquid droplet plasma source material handling system according to aspects of an embodiment of the present invention.
Figure 7:
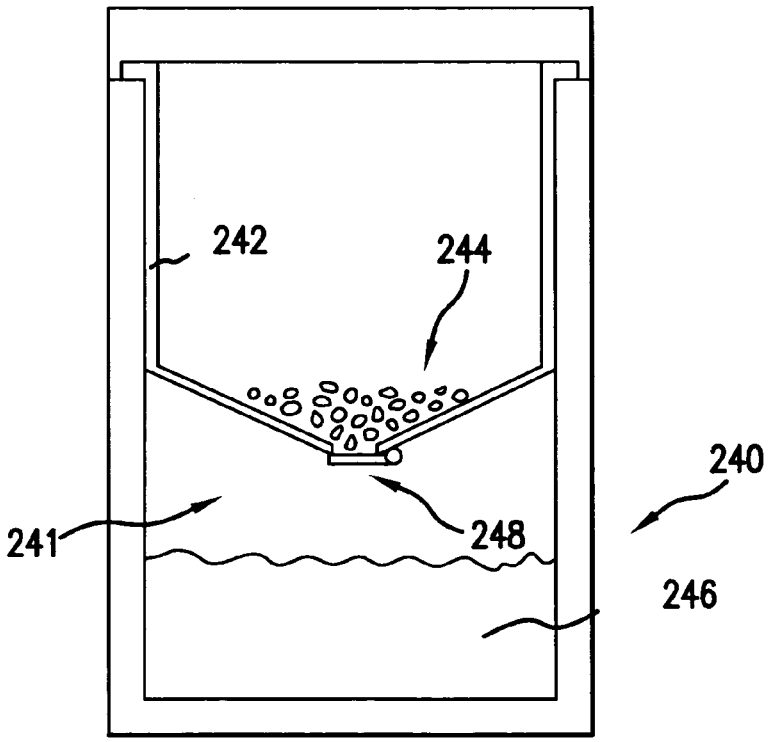
FIG. 7 shows schematically and partly in cross section a liquid droplet plasma source material handling system according to aspects of an embodiment of the present invention; and, FIG. 8 shows schematically and partly in cross section a liquid droplet plasma source material handling system according to aspects of an embodiment of the present invention.
Figure 8:
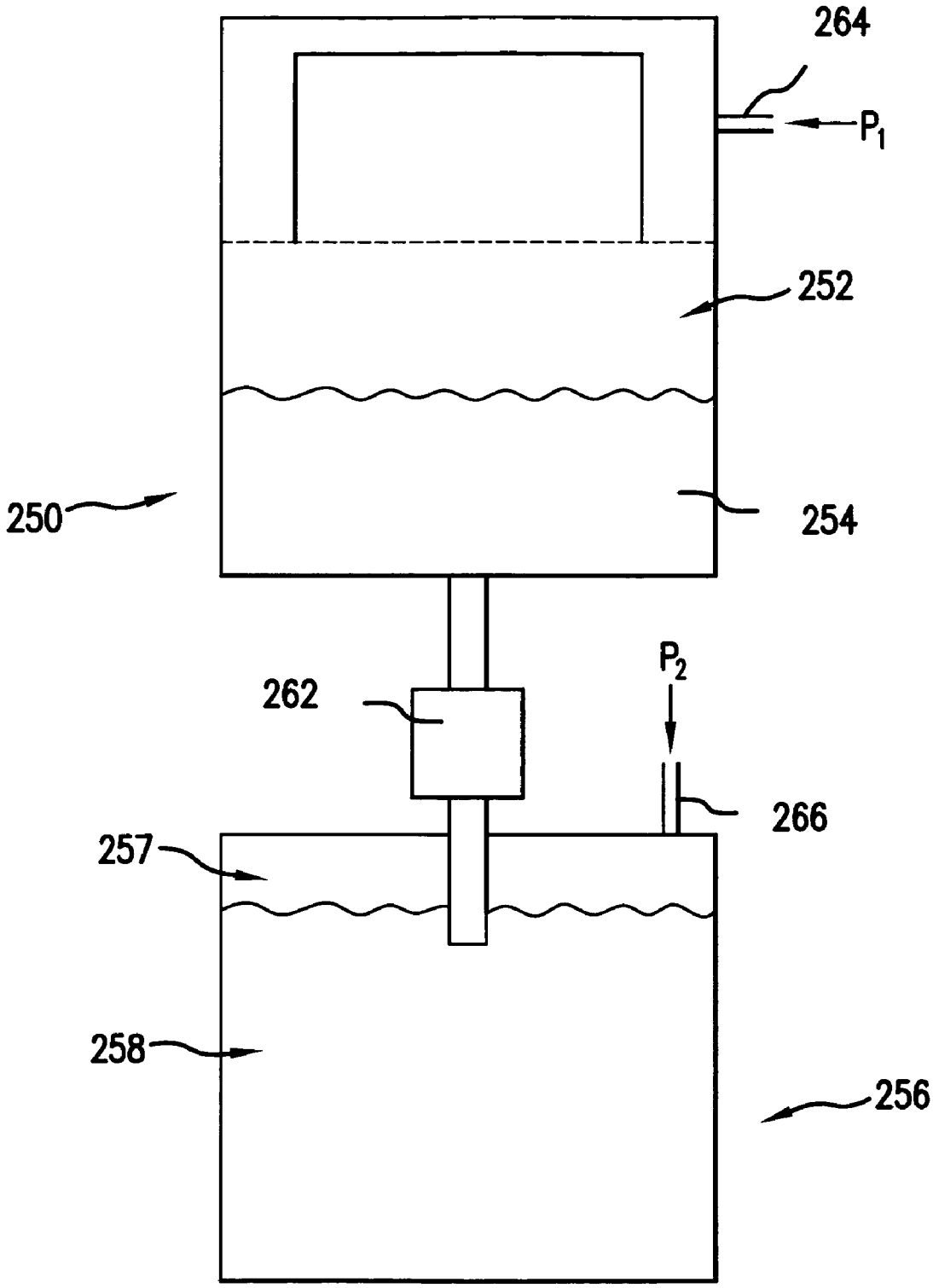

Turning now to FIG.'s 6–8 there is shown partly schematically and partly in cross section aspects of embodiments of liquid plasma source target material handling systems. FIG. 6 show, by way of example, a supply system 230, which may comprise, e.g., a reservoir 231 having side walls 232 that are adapted to frictionally holding a solid piece of plasma source material 238, e.g., from having created theron roughened surface regions 232. From the solid plasma formation material 238 liquid/molten plasma formation material may be formed to establish or contribute to a molten plasma source material mass 236 in the reservoir. This may be accomplished by utilizing a series of discretely actuatable heater rings 234. Turning now to FIG. 7 there is shown a supply 240, which may comprise a supply reservoir 241, within which may be mounted a dispensable form of solid plasma source material dispenser, e.g., a hopper 242, which may contain solid plasma source material 244 in a dispensable form, e.g., pellets or powder and from which molten plasma source material 246 can be formed or contributed to, e.g., by opening a hopper remotely controlled door 248. Turning now to FIG. 8 there is shown partly schematically and partly in cross section, a plasma source material supply container 250, including, e.g., a plasma source material reservoir 252 containing a molten plasma source material 254. Also shown, by way of example is a droplet generator plasma source material reservoir 256 containing a reservoir 257 containing molten plasma source material 258. The reservoirs 252 and 261 may be interconnected by an interconnection tube 260, containing, e.g., a cold valve 262, through which liquid/molten plasma source material may be transmitted, e.g., as shown illustratively by force of gravity with the valve 262 open. Also shown, by way of example is a means to force liquid/molten plasma material 254 to the reservoir 257, e.g., by applying a pressure $P_1$ through pressure connection 264 and a pressure $P_2$ through a pressure connection 266, such that $P_1>P_2$, with $P_2$ at some pressure selected to at least assist in making the droplet generator (not shown in FIG. 8) in fluid communication with the reservoir 257 operate properly.

Those skilled in the art will understand that as explained above according to aspects of an embodiment of the present invention an EUV light source plasma source material handling system and method is disclosed which may comprise a droplet generator having a droplet generator plasma source material reservoir in fluid communication with a droplet formation capillary, which may comprise a generally narrowed passageway in the droplet generator intermediate the reservoir and an output orifice of the droplet generator and may also comprise some form of a a nozzle portion at the discharge end of the capillary, including for example simply a narrowing portion of the capillary leading to a discharge opening/orifice. The source material reservoir and capillary may, e.g., be maintained within a selected range of temperatures sufficient to keep the plasma source material in a liquid form as will be understood by those skilled in the art, dependent upon the type of plasma source material, e.g., tin or lithium, which are metals that are solid at room temperature and must be heated to some temperature to be melted and also perhaps kept above some temperature to insure maintenance of molten form throughout. The plasma source material may also be in some form, e.g., a compound of tin or lithium that is liquid at room temperature, and may be kept in solid form by reducing its temperature and later again allowing it to go to some ambient temperature at which it becomes liquid. Liquid and molten are used in this application and the appended claims to mean the same in this regard, i.e., regardless of whether or not the technically speaking its ordinary room temperature form is solid and it is heated to make it liquid/molten or its ordinary room temperature form is liquid and it is cooled to make it solid/frozen.

A plasma source material supply system may be included, e.g., which may have a supply reservoir in fluid communication with the droplet generator plasma source material reservoir and hold at least a replenishing amount of plasma source material in liquid form for transfer to the droplet generator plasma source material reservoir, while the droplet generator is on line. Those skilled in the art of material handling and transfer will understand that the specifics of the replenishing amount may be a balance, e.g., between the frequency of transfers from one reservoir to the other that may be desirable and the possibility of, e.g., slag layers forming in the reservoir(s) if too large in size. A transfer mechanism, which may be as simple as a gravity driven transfer conduit, e.g., with a control valve, or utilize a suitable pump capable of pumping the material being transmitted, or differentially pressurized chambers, or other forms of transferring liquid plasma source material from, e.g., the supply reservoir to the droplet generator plasma source material reservoir, while the droplet generator is at temperature or on line, as will be understood by those skilled in the fluid materials handling art. By on line or at temperature is meant according to aspects of an embodiment of the present invention to mean that an advantage of the present invention allows for simple, easy, relatively time efficient ways to replenish the liquid plasma source material in the droplet generator reservoir as that is being depleted by the ongoing droplet formation and the limits of a finite space in the droplet generator reservoir and the issues with overly large volume reservoirs that are noted herein, without having to perform certain potentially contaminating and/or time consuming operations, such as breaking the seal of the droplet generator reservoir or cooling down part or all of the plasma source material delivery system. Ordinarily this means that the system can be replenished over and over while the system is "on line," i.e., continuing to operate. However, it may be considered that certain states of operation, in idle or standby and so forth, where, e.g., EUV light is not being generated and thus droplet generation is not called for, are not states of being "on line." However, whether droplets are being generated or not, the system may still be considered to be "on line." as long as it is not shut down, such as for maintenance, and thus maintenance of the liquid/molten condition of the plasma source material in the plasma source material droplet generator reservoir is not needed. For purposes of this application and the appended claims, "on line" or "at temperature" are considered to be any state where the liquid/molten state of the plasma source material at least in the plasma source material droplet generator reservoir (and concomitantly the liquid discharge portion of the droplet generator) is desirable and/or necessary.

The transfer mechanism may comprise a conduit interconnecting the supply system reservoir and the droplet generator plasma source material reservoir. The transfer mechanism may comprise a valve isolating the supply reservoir from the droplet generator plasma source material reservoir, which may be a simple as a heating/cooling mechanism to solidify plasma source material in a transfer tube to stop flow and liquify it to allow flow, or other forms of valves, e.g., typically remotely operated, e.g., by a solenoid to permit or block flow. The supply reservoir may comprise a solid form of the plasma source material used to periodically form from a portion of the material in solid form the material in liquid form. The transfer mechanism may comprise a heater mechanism operative to apply heat primarily to a surface of the solid form of the plasma source material. The transfer mechanism may comprise a heat actuated valve between the supply reservoir and the droplet generator plasma source material reservoir. The apparatus and method may comprise a displaced heater mechanism disposed above a molten material gathering region of the supply reservoir operative to apply heat to a solid form of the plasma source material in the vicinity of the displaced heater mechanism, e.g., a meshed screen that can be heated under remote control to melt solid plasma source material in contact with the heater.

The apparatus and method may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is at temperature; a transfer mechanism transferring liquid plasma source material from the supply reservoir to the droplet generator plasma source material reservoir, while the droplet generator is at temperature, a discharge end of the transfer mechanism positioned below the upper surface of the droplet generator plasma source material in the droplet generator plasma source material reservoir during such transferring.

The apparatus and method may comprise a droplet generator having a droplet generator plasma source material reservoir in fluid communication with a droplet formation capillary and maintained within a selected range of temperatures sufficient to keep the plasma source material in a liquid form; a plasma source material supply system having a supply reservoir displaced above the droplet generator plasma source material reservoir, in fluid communication with the droplet generator plasma source material reservoir and holding at least a replenishing amount of plasma source material in liquid form for transfer to the droplet generator plasma source material reservoir, while the droplet generator is at temperature; a transfer mechanism transferring liquid plasma source material from the supply reservoir to the droplet generator plasma source material reservoir, while the droplet generator is at temperature and a liquid plasma source material handling controller maintaining a level of droplet generator plasma source material in the droplet generator plasma source reservoir based upon the sensing of the level of the droplet generator plasma source material in the droplet generator plasma source material reservoir and the sensing of a level of liquid plasma source material in the supply reservoir. The apparatus and method may comprise the controller controlling a heating mechanism heating at least one surface of a solid form of the plasma source material in the supply reservoir prior to the transferring in response to a sensing of the level of liquid plasma source material in the supply reservoir. The apparatus and method may comprise the controller controlling the heating of at least one surface of a solid form of plasma source material in the supply reservoir after the transferring responsive to the sensing of a level of liquid plasma source material in the supply reservoir. Other variations are also possible, the point being that an amount necessary and/or sufficient for a given selected replenishment may always be maintained in the supply reservoir, and solid plasma source material melted after such a replenishment to enable the next replenishment, or little or no liquid/molten plasma source material maintained in liquid form in the supply reservoir until a replenishment is signaled by the controller and then solid plasma source material in sufficient quantity may be melted for the given replenishment, or replenishments may be of variable sizes and the liquid/molten plasma source material in the supply reservoir supplemented as necessary before a given replenishment or melted to the necessary/sufficient level. Those skilled in the art will also understand that a variety of control systems with a variety of different level sensors to provide the input needed for the controller to determine that state of the necessary replenishment to the droplet generator plasma source material reservoir and the available liquid/molten material in the supply reservoir, including such things as need lead tome for melting the replenishing amount into the molten portion of the supply reservoir and the like.

The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, comprising the steps of: utilizing an initial cleaning and conditioning process to achieve stable long-term performance, due to initial contamination due to liquid metal and plasma source material handling system component chemical interaction by providing an initial flush of the system. The flush may be carried out at a selected temperature and introduced in sufficient quantity to avoid clogging, which will be understood by those skilled the art, e.g., depending on the material comprising the plasma source material and materials comprising wetted components of the system and the like. The method and apparatus may comprise subjecting plasma source material handling system component surfaces in contact with the plasma source material to a passivation process. The passivation material may comprise an acid bath to leech out materials through the component surfaces reactive with molten plasma source material. The method and apparatus may comprise choosing materials for surfaces wetted by the liquid plasma source material to substantially limit the formation of intermetallic compounds by the wetted surface material and the liquid plasma source material, such that blockage by such contaminants and/or precipitates and the like do not substantially block or clog narrow portions of the system over an operationally acceptable period of time between system maintenance such a cleaning and flushing.

The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, which may comprise the steps of: utilizing an inline filter intermediate the plasma source material supply system and the droplet generator plasma source material reservoir to prevent contaminants in the plasma source material reservoir from reaching the droplet generator plasma source material reservoir. The method and apparatus may comprise providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, which may comprise the steps of: maintaining temperatures in at least one selected portion of the material handling system so as to avoid thermal gradients within the at least one selected portion sufficient to cause solubility differences sufficient to precipitate out insoluble compounds as particulate, as will be understood by those skilled in the art based on the materials involved.

The method and apparatus may comprise maintaining at least one selected portion of the material handling system downstream of a valve in the transfer mechanism at an elevated temperature sufficient to avoid blockage of at lest one narrowed passage portion of the at least one selected portion. The at least one selected portion is selected from the capillary, a nozzle at the discharge end of the capillary and an output orifice in the nozzle. The method and apparatus may comprise an EUV light source plasma source material handling system which may comprise: a droplet generator having a droplet generator plasma source material reservoir in fluid communication with a droplet formation capillary and maintained within a selected range of temperatures sufficient to keep the plasma source material in a liquid form as will be understood by those skilled in the art; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator at temperature; a storage mechanism storing plasma source material in a solid form within the droplet generator plasma source material supply system to replenish the plasma source material in the molten portion of the supply system reservoir. The method and apparatus may comprise a porous separator, e.g., a wire mesh, separating a solid form storage portion of the plasma source material supply system reservoir from the molten plasma source material supply system reservoir; a heating mechanism heating the porous separator to inject liquid plasma source material into the molten portion of the plasma source material supply system reservoir by melting at least a portion of the solid form of the plasma source material. The method and apparatus may comprise a hopper in the plasma source material supply system reservoir containing plasma source material in a solid dispensable form comprising a remotely operated dispensing mechanism delivering a selected quantity of the solid dispensable plasma source material to the molten plasma material portion of the plasma source material supply system reservoir. The dispensable form may comprise a pellet form or a powder form or other forms of solid that can be made to flow out of the hopper, e.g., under gravity force, when the door is opened. The apparatus and method may comprise a holding mechanism holding the solid form plasma source material separate from the molten portion of the plasma source material supply system reservoir; a segmented heating mechanism selectively heating a selected segment of the solid form plasma source material in the plasma source material supply system reservoir to replenish the liquid form plasma source material in the molten portion of the plasma source material supply system reservoir. It will be understood by those skilled in the art that the aspects of embodiments of the present invention disclosed above are intended to be preferred embodiments only and not to limit the disclosure of the present invention (s) in any way and particularly not to a specific preferred embodiment alone. Many changes and modification can be made to the disclosed aspects of embodiments of the disclosed invention(s) that will be understood and appreciated by those skilled in the art. The appended claims are intended in scope and meaning to cover not only the disclosed aspects of embodiments of the present invention(s) but also such equivalents and other modifications and changes that would be apparent to those skilled in the art. In additions to changes and modifications to the disclosed and claimed aspects of embodiments of the present invention(s) noted above the following could be implemented.

We claim:

1. An EUV light source plasma source material handling system comprising:

a droplet generator having a droplet generator plasma source material reservoir in fluid communication with a droplet formation capillary and maintained within a selected range of temperatures sufficient to keep the plasma source material in a liquid form;

a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is at temperature;

a transfer mechanism transferring liquid plasma source material from the supply reservoir to the droplet generator plasma source material reservoir, while the droplet generator is at temperature.

2. The apparatus of claim 1 further comprising:

the transfer mechanism comprising a conduit interconnecting the supply reservoir and the droplet generator plasma source material reservoir.

3. The apparatus of claim 2 further comprising:

the transfer mechanism comprising a valve isolating the supply reservoir from the droplet generator plasma source material reservoir.

4. The apparatus of claim 3 further comprising:

the supply reservoir comprising a solid form of the plasma source material used to periodically form from a portion of the material in solid form the material in liquid form.

5. The apparatus of claim 4 further comprising:

the transfer mechanism comprising a heater mechanism operative to apply heat primarily to a surface of the solid form of the plasma source material.

6. The apparatus of claim 5 further comprising:

the transfer mechanism comprising a heat actuated valve between the supply reservoir and the droplet generator plasma source material reservoir.

7. The apparatus of claim 6 further comprising:

a displaced heater mechanism disposed above a molten material gathering region of the supply reservoir operative to apply heat to a solid form of the plasma source material in the vicinity of the displaced heater mechanism.

8. An EUV light source plasma source material handling system comprising:

a droplet generator having a droplet generator plasma source material reservoir in fluid communication with a droplet formation capillary and maintained within a selected range of temperatures sufficient to keep the plasma source material in a liquid form;

a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is at temperature;

a transfer mechanism transferring liquid plasma source material from the supply reservoir to the droplet generator plasma source material reservoir, while the droplet generator is at temperature, a discharge end of the transfer mechanism positioned below the upper surface of the droplet generator plasma source material in the droplet generator plasma source material reservoir during such transferring.

9. An EUV light source plasma source material handling system comprising:

a droplet generator having a droplet generator plasma source material reservoir in fluid communication with a droplet formation capillary and maintained within a selected range of temperatures sufficient to keep the plasma source material in a liquid form;

a plasma source material supply system having a supply reservoir displaced above the droplet generator plasma source material reservoir, in fluid communication with the droplet generator plasma source material reservoir and holding at least a replenishing amount of plasma source material in liquid form for transfer to the droplet generator plasma source material reservoir, while the droplet generator is at temperature;

a transfer mechanism transferring liquid plasma source material from the supply reservoir to the droplet generator plasma source material reservoir, while the droplet generator at temperature.

10. The apparatus of claim 9 further comprising:

a liquid plasma source material handling controller maintaining a level of droplet generator plasma source material in the droplet generator plasma source reservoir based upon the sensing of the level of the droplet generator plasma source material in the droplet generator plasma source material reservoir and the sensing of a level of liquid plasma source material in the supply reservoir.

11. The apparatus of claim 10 further comprising:

the controller controlling a heating mechanism heating at least one surface of a solid form of the plasma source material in the supply reservoir prior to the transferring in response to a sensing of the level of liquid plasma source material in the supply reservoir.

12. A method of providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, comprising the steps of:

utilizing an initial cleaning and conditioning process to achieve stable long-term performance, due to initial contamination due to liquid metal and plasma source material handling system component chemical interaction by providing an initial flush of the system.

13. The method of claim 12 further comprising:

the flush is carried out at a selected temperature and introduced in sufficient quantity to avoid clogging.

14. The method of claim 13 further comprising:

subjecting plasma source material handling system component surfaces in contact with the plasma source material to a passivation process.

15. The method of claim 14 further comprising:

the passivation material comprises an acid bath to leech out materials through the component surfaces reactive with molten plasma source material.

16. The method of claim 15 further comprising:

choosing materials for surfaces wetted by the liquid plasma source material to substantially limit the formation of intermetallic compounds by the wetted surface material and the liquid plasma source material.

17. A method of providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, comprising the steps of:

utilizing an inline filter intermediate the plasma source material supply system and the droplet generator plasma source material reservoir to prevent contaminants in the plasma source material reservoir from reaching the droplet generator plasma source material reservoir.

18. A method of providing EUV light source plasma source material in a plasma source material handling system comprising a droplet generator having a droplet generator plasma source material reservoir; a droplet formation capillary maintained within a selected range of temperatures sufficient to keep the plasma source material in a liquid form and a plasma source material supply system having a supply reservoir and a transfer mechanism transferring liquid plasma source material from the supply reservoir to the droplet generator plasma source material reservoir, comprising the steps of:

maintaining temperatures in at least one selected portion of the material handling system so as to avoid thermal gradients within the at least one selected portion sufficient to cause solubility differences sufficient to precipitate out insoluble compounds as particulate.

19. The method of claim 18 further comprising:

maintaining at least one selected portion of the material handling system downstream of a valve in the transfer mechanism at an elevated temperature sufficient to avoid blockage of at lest one narrowed passage portion of the at least one selected portion.

20. The method of claim 19 further comprising:

the at least one selected portion is selected from the capillary, a nozzle at the discharge end of the capillary and an output orifice in the nozzle.

21. An EUV light source plasma source material handling system comprising:

a droplet generator having a droplet generator plasma source material reservoir in fluid communication with a droplet formation capillary and maintained within a selected range of temperatures sufficient to keep the plasma source material in a liquid form;

a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator at temperature;

a storage mechanism storing plasma source material in a solid form within the droplet generator plasma source material supply system to replenish the plasma source material in the molten portion of the supply system reservoir.

22. The apparatus of claim 21 further comprising:

a porous separator separating a solid form storage portion of the plasma source material supply system reservoir from the molten plasma source material supply system reservoir;

a heating mechanism heating the porous separator to inject liquid plasma source material into the molten portion of the plasma source material supply system reservoir by melting at least a portion of the solid form of the plasma source material.

23. The apparatus of claim 22 further comprising:

a hopper in the plasma source material supply system reservoir containing plasma source material in a solid dispensable form comprising a remotely operated dispensing mechanism delivering a selected quantity of the solid dispensable plasma source material to the molten plasma material portion of the plasma source material supply system reservoir.

24. The apparatus of claim 23 further comprising:

the dispensable form is a pellet form or a powder form.

25. The apparatus of claim 24 further comprising:

a holding mechanism holding the solid form plasma source material separate from the molten portion of the plasma source material supply system reservoir;

a segmented heating mechanism selectively heating a selected segment of the solid form plasma source material in the plasma source material supply system reservoir to replenish the liquid form plasma source material in the molten portion of the plasma source material supply system reservoir.

* * * * *